United States Patent [19]

Ferguson

[11] Patent Number: 5,073,308

[45] Date of Patent: Dec. 17, 1991

[54] CARBURETOR IDLE JET VENTING DEVICE

[76] Inventor: McCrea Ferguson, 3606 Jeffrey Dr., Modesto, Calif. 95355

[21] Appl. No.: 611,886

[22] Filed: Nov. 13, 1990

[51] Int. Cl.[5] ..... F02M 3/055

[52] U.S. Cl. ..... 261/41.5; 261/DIG. 19; 261/DIG. 38

[58] Field of Search ..... 261/41.5, DIG. 38, DIG. 19

[56] References Cited

U.S. PATENT DOCUMENTS

| | | | |
|---|---|---|---|
| 2,763,285 | 9/1956 | Reeves | 261/DIG. 38 |
| 3,000394 | 9/1961 | Gold et al. | 261/DIG. 19 |
| 3,042,387 | 7/1962 | King | 261/DIG. 19 |
| 3,077,341 | 2/1963 | Schlichting | 261/39 |
| 3,313,532 | 4/1967 | Carlson et al. | 261/39 |
| 3,348,823 | 10/1967 | Roquerre | 261/41 |
| 4,376,738 | 3/1983 | Reinmuth | 261/DIG. 19 |

*Primary Examiner*—Tim Miles

*Attorney, Agent, or Firm*—Charles E. Temko

[57] ABSTRACT

An improved vacuum operated air valve for incorporation into the idle fuel port of an automotive carburetor. The valve includes a valve seat having an inner conically-shaped area and a surrounding planar area. The valve member includes an axially oriented stem and a flat radially-extending head, an outer end surface of which overlies the valve seat surfaces, whereby opening the valve to a very minute axial displacement opens a substantial venting area, increasing the sensitivity of the valve.

2 Claims, 1 Drawing Sheet

CARBURETOR IDLE JET VENTING DEVICE

BACKGROUND OF THE INVENTION

This invention relates to a carburetor idle port valve for internal combustion engines. The valve is used for controlling the air and fuel mixture in the carburetor during such periods as the throttle is in closed position, and the engine is fed fuel only through the idle port and jet. Devices of this general type are well known in the art, and the invention lies in specific constructional details which permit sensitive operation without need for overriding manual control, while maintaining the cost of manufacture at a very reasonable level.

The idling system in a carburetor supplies a small quantity of an air and fuel mixture to keep the engine running when the throttle is closed or nearly closed. As the throttle is opened, an increased suction is applied to the idling system and more fuel is supplied thereby. An increased suction is likewise applied to the main fuel discharge nozzle as the throttle is opened and fuel is discharged therefrom with a gradual reduction in discharge from the idle system until the discharge in the idle system is neglible. The discharge from the idling system, when transferring to the main discharge system as the throttle is being opened, or when the throttle remains only partly open, is normally overenriched as the idling system is normally calibrated at one specific position.

Overenrichment of the fuel system of a carburetor can and has brought about undesirable results. A simple overenrichment results in a waste of fuel and thus, a loss in economy of operation. More importantly, in recent years, the presence of unburned hydrocarbons in the exhaust gases from automotive engines have been found to contribute to an undesirable atmospheric condition more commonly called "smog". It is generally understood that too rich a fuel mixture may easily result in incomplete burning, due to lack of sufficient oxygen, which, in turn, results in the discharge of unburned hydrocarbons and incomplete combustion of other hydrocarbons to produce carbon monoxide.

In present day automotive carburetors, the only adjustment normally available is the idle fuel needle screw wherein the needle adjustment is set to give smooth operation at curb idle. It is known to provide in the aftermarket, devices such as that disclosed in U.S. Pat. No. 3,348,823, to Roquèrre and U.S. Pat. No. 3,077,341 to Schlichting which supplement normal needle valve adjustment with a resilient check valve which becomes operative during periods of high vacuum. At the present time, such devices are useful only in those automobiles which are equipped with carburetors, as distinguished from fuel injection devices. Such cars are substantially older, and are characterized by normal high fuel consumption and relatively little net worth. With the recently occurring increases in the cost of fuel, it becomes highly desirable to provide a device of this type which can be manufactured at very low cost and which is easily installed.

SUMMARY OF THE INVENTION

Briefly stated, the invention contemplates the provision of an improved vacuum operated venting means which is installed in the idle fuel supply which is not only relatively inexpensive to manufacture, but which possesses high sensitivity to the occurrence of low vacuum pressures which occur when the engine is above idle speed and the throttle is substantially closed. Such periods occur when the automobile is decelerating, or when the engine is used to brake the automobile when descending hills. As distinguished from most prior art devices which employ a ballcheck, the present invention contemplates the use of a valve member of generally nail-like configuration including an axially oriented stem and a flat head, the outer planar surface of which overlies a valve seat which is partially conical surrounded by a planar area. The normal contact is only upon the planar area enabling something greater than line contact, and permitting a substantial area of the head to overlie the conical portion where it is exposed to atmospheric pressure at all times. This construction has been found to provide unexpectedly high sensitivity while yet maintaining an adequate seal during periods of no vacuum pressure, which has been a shortcoming of devices employing a ballcheck.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
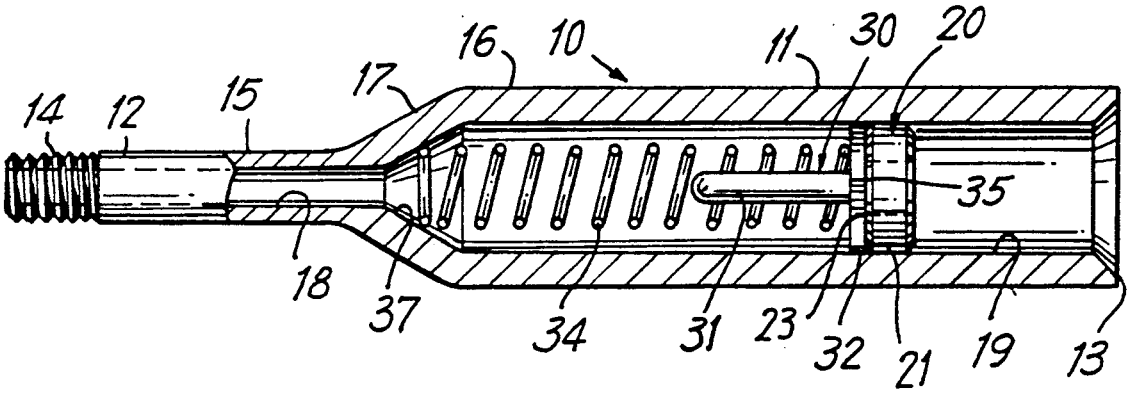
FIG. 1 is a longitudinal central sectional view of an embodiment of the invention.
Figure 2:
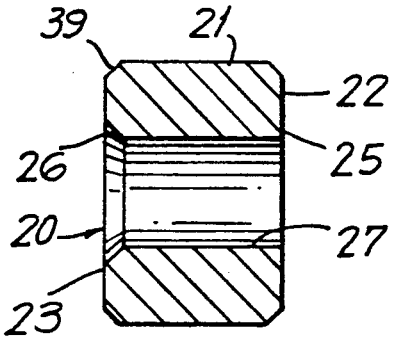
FIG. 2 is an enlarged longitudinal sectional view of the valve seat member comprising a part of the embodiment.
Figure 3:
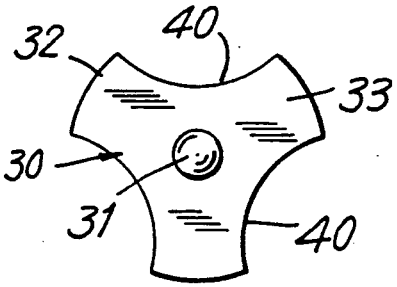
FIG. 3 is an enlarged end elevational view of a valve element.

In accordance with the invention, the device, generally indicated by reference character 10, includes an elongated hollow body 11 of machined brass or die cast zinc extending between first and second ends 12 and 13, respectively. The first end 12 is provided with a threaded tip 14 for engagement within the exposed idle port of the associated carburetor (not shown). Extending outwardly from the tip 14 is a slender medially disposed tubular portion 15 merging into a wider medially disposed portion 16 through a tapered portion 17. The portion 15 includes an axially aligned narrow channel 18 communicating with a wider channel 19 in the portion 16.

A washer-like valve seat 20 is frictionally retained within the channel 19, and is bounded by an outer cylindrical surface 21, an outer end surface 22, and an inner end surface 23 which forms a two-part valve seat. The seat includes an outer annular planar surface 25 and an inner conical surface 26 extending to a through bore 27.

A resiliently urged valve member 30 includes an axially oriented stem 31 and a planar radially extending head 32, the latter being bounded by an inner surface 33 which bears against a compression spring 34. The outer surface 35 overlies the valve seat, and in closed condition contacts only the planar surface 25. The opposite end of the spring 34 is constrained by the conically shaped surface 37 which interconnects the channels 18 and 19. The tension on the spring is adjusted by the positioning of the valve seat 20 with respect to the channel 19. Using a cylindrical seating tool (not shown) having an adjustable threaded nut on an outer surface thereon to determine the degree of penetration into the channel 19.

In order to maintain the surface area of surface 25 at approximately that of the conical surface 26, the inner edge is slightly chamfered at 39. The head 32 is provided with indentations 40 to enhance the sensitivity of the valve when opened.

As will be readily apparent, much of the venting action will take place with the valve member 30 only slightly displaced from the seat 20. This will occur at relatively low volume occurring when the engine is rotating at above idle speed with the throttle closed. The action is far superior to conventional ballcheck valve which presents relatively little surface to the incoming inducted air, and the surface below the line contact of the ball with the seat is the only part of the ball which is effective to receive contact from the air. Thus, substantially more vacuum is required to unseat the ballcheck valve than the valve employed in the present construction.

I wish it to be understood that I do not consider the invention to be limited to the precise details of structure shown and set forth in this specification, for obvious modifications will occur to those skilled in the art to which the invention pertains.

I claim:

1. In a device for bleeding ambient air into a carburetor idle fuel port, the device, including a vacuum responsive check valve which opens upon the occurrence of above idle vacuum pressure, the improvement comprising: an elongated hollow body having an axially oriented continuous passage extending between first and second ends; said body having threaded engagement means on said first end for engaging said idle fuel port; a washer-like plug positioned within said passage and forming a valve seat including an outer annular planar surface and a centrally disposed conical portion surrounded by said planar area; a slideably disposed valve element including an axially-oriented stem and a transversely extending generally planar head, said head having inner and outer surfaces, and a compression coil spring surrounding said stem and bearing upon said inner surface; said outer surface of said head overlying said valve seat; whereby, when said valve element is in closed position, sealing is effected solely by the contact of said outer surface with said planar area of said valve seat, and upon the opening thereof, only minimal axial displacement is necessary to provide substantial venting action.

2. The improvements set forth in claim 1, further characterized in said conical area of said valve seat being substantially equal to that of said planar area.

* * * * *